US005981887A

United States Patent [19]

Robarge et al.

[11] Patent Number: 5,981,887

[45] Date of Patent: Nov. 9, 1999

[54] CONTACT POSITION INDICATOR FOR AN INDUSTRIAL-RATED CIRCUIT BREAKER

[75] Inventors: Dean A. Robarge, Southington; Roger N. Castonguay, Terryville; James L. Rosen, West Hartford; Andre J. M'Sadoques, Southington, all of Conn.

[73] Assignee: General Electric Company, Schenectady, N.Y.

[21] Appl. No.: 08/997,107

[22] Filed: Dec. 23, 1997

[51] Int. Cl.[6] ..... H01H 9/16

[52] U.S. Cl. ..... 200/308

[58] Field of Search ..... 200/308, 400, 200/401

[56] References Cited

U.S. PATENT DOCUMENTS

| | | | |
|---|---|---|---|
| 3,084,238 | 4/1963 | Baskerville | 200/400 |
| 3,095,489 | 6/1963 | Baird | 200/400 |
| 3,729,065 | 4/1973 | Baskerville et al. | 185/39 |
| 4,167,988 | 9/1979 | Acampora et al. | 185/40 R |
| 4,475,021 | 10/1984 | Mochizuki et al. . | |
| 4,672,501 | 6/1987 | Bilac et al. | 361/96 |
| 5,477,016 | 12/1995 | Baginski et al. | 200/308 X |

*Primary Examiner*—Renee S. Luebke

*Attorney, Agent, or Firm*—Cantor Colburn LLP; Carl B. Horton

[57] ABSTRACT

A circuit breaker ON/OFF contact position indicator employs a bell crank assembly interconnecting between the target indicator at the front of the circuit breaker enclosure and the circuit breaker contact closing shaft at the rear thereof to provide accurate real time indication of the ON/OFF condition of the circuit breaker contacts.

16 Claims, 5 Drawing Sheets

CONTACT POSITION INDICATOR FOR AN INDUSTRIAL-RATED CIRCUIT BREAKER

BACKGROUND OF THE INVENTION

Air circuit breakers as described within U.S. Pat. Nos. 3,095,489 entitled "Manual Charging Means for Stored Energy Closing Mechanisms of Electric Circuit Breakers" and 3,084,238 entitled "Ratchet Mechanism for Charging a Closing Spring in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

Such air circuit breakers are usually provided with a motor operator such as described in U.S. Pat. No. 4,167,988 entitled "Ratcheting Mechanism for Circuit Breaker Motor Operator" or a manual handle as described in U.S. Pat. No. 3,729,065 entitled "Means for Charging A Stored Energy Circuit Breaker Closing Device" for charging the powerful closing springs contained within the air circuit breaker operating mechanism.

When the circuit breaker closing springs are brought to their fully-charged conditions, it is important that the springs do not become inadvertently discharged while an operator has hold of the charging handle in order to avoid damage to the ratchet mechanism and the associated air circuit breaker contacts. An early arrangement of a latching means to prevent rotation of a closing springs charging handle is found in U.S. Pat. No. 4,475,021 entitled "Air Circuit Breaker".

When the circuit breaker closing springs are completely charged, the holding pawl is removed from the charging gear to allow the charging shaft to rotate in the reverse direction when the circuit breaker closing button is activated, as described in U.S. Pat. No. 8,883,351 entitled "Ratcheting Mechanism for Industrial-Rated Circuit Breaker" filed on May 27, 1997.

Although the circuit breaker contacts along with the circuit breaker operating mechanism are located in air, the position of the contacts behind the circuit breaker enclosure makes it difficult, if not impossible, to determine the true status of the circuit breaker contacts relative to the ON and OFF conditions One arrangement to determine the condition of the circuit breaker contacts is to provide a viewing window in the front cover of the circuit breaker and position a target indicator under the window to display the ON/OFF status. The target indicator mechanically links with the circuit breaker closing shaft to accurately position the ON/OFF indicia with respect to the circuit breaker contacts.

U.S. Pat. No. 5,823,3238 entitled "Circuit Breaker Contact Position Indicating Unit" filed on Feb. 3 1997 and U.S. patent application Ser. No. 08/878,598 entitled "Contact Position Indicator for an Industrial-Rated Circuit Breaker" filed on Jun. 19, 1997 describe such visual contact indication in high-ampere industrial rated type circuit breakers. The components interconnecting between the target indicator and the circuit breaker operating mechanism are designed to meet the high-ampere requirements.

With lower ampere-rated industrial circuit breaker assemblies, the limited space available does not readily lend to the use or application of similar position indication components.

One purpose of the invention, accordingly, is to describe a simple target indication arrangement for use with industrial-rated circuit breakers of lower ampere-rating.

SUMMARY OF THE INVENTION

A circuit breaker ON/OFF contact position indicator employs a bell crank assembly interconnecting between the target indicator at the front of the circuit breaker enclosure and the circuit breaker contact closing shaft at the rear thereof to provide accurate real time indication of the ON/OFF condition of the circuit breaker contacts. One end of the bell crank assemble pivotally attached to the target indicator while the opposite end interfaces with the contact closing shaft in cam-follower relation.

DESCRIPTION OF THE PREFERRED EMBODIMENT

Figure 1:
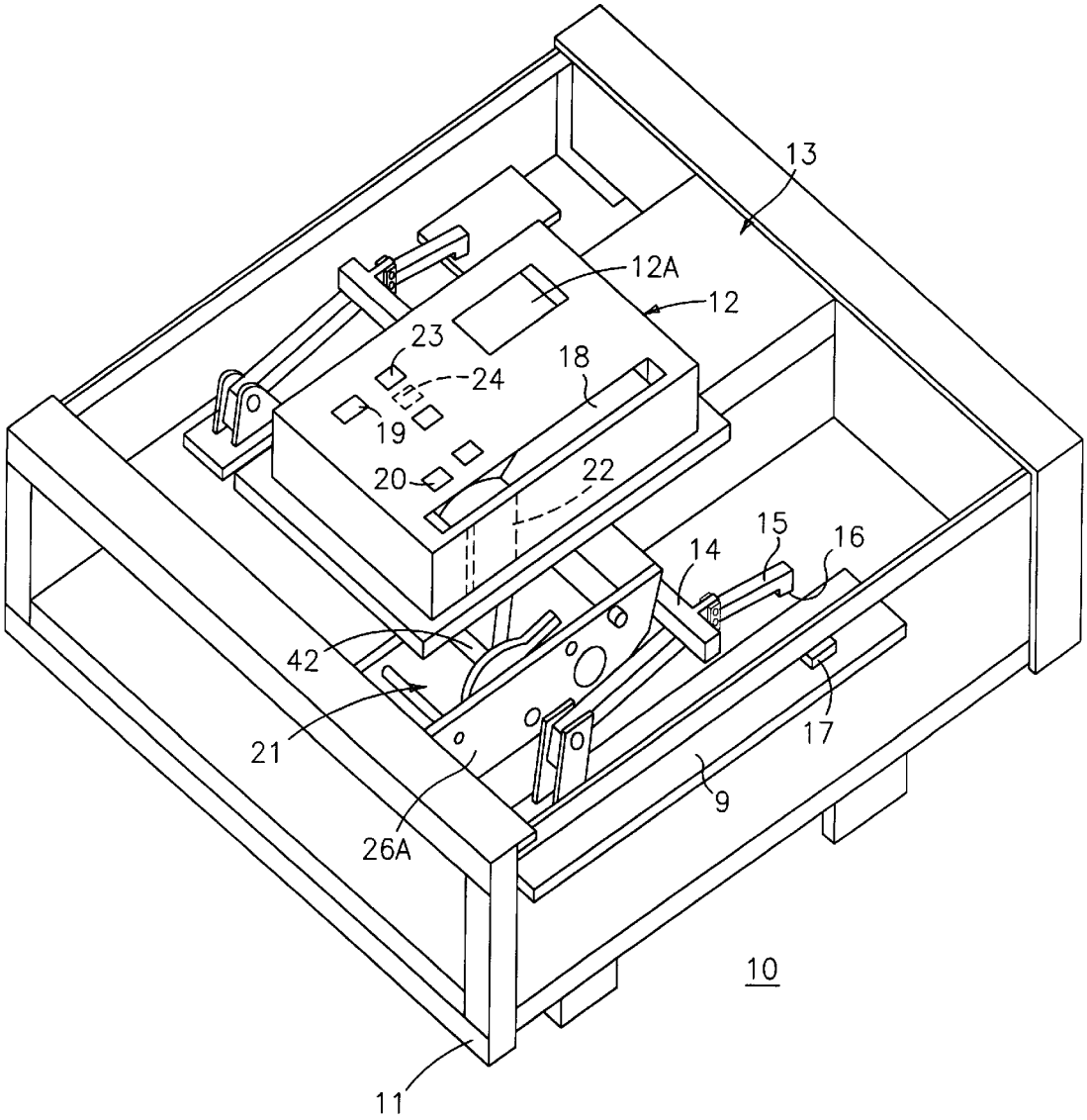
FIG. 1 is top respective view of an air circuit breaker containing the contact indication assembly according to the invention.

The air circuit breaker 10 of FIG. 1 is similar to that described within the aforementioned U.S. Pat. No. 3,095,489 and includes a metal frame 11 which supports circuit breaker cover 12, the trip unit programmer 12-A and the operating mechanism enclosure 13. The trip unit programmer is similar to that described in U.S. Pat. No. 4,672,501 entitled "Circuit Breaker and Protective Relay Unit". The cover further includes a TRIP or OFF button 19 for releasing the circuit breaker operating mechanism contained within the enclosure 13 for separating the circuit breaker contacts 16, 17 to their open condition and a closing button 20 for moving the contacts to their closed position. One of the viewing windows 23 provides viewing access to the indicator flag 24 which is the subject of this invention. The circuit breaker movable contact arms 15 within each pole of a three pole circuit arrangement, are arranged on a bottom support plate 9 and are interconnected by means of the operating mechanism crossbar 14 to insure that movable and fixed contacts 16, 17 within the separate poles both open and close in unison. The circuit breaker operating mechanism 21 operates in the manner described in the aforementioned U.S. Pat. No. 3,729,065 by allowing the operating mechanism closing springs described therein to be charged and released by means of the drive lever shaft 42 that connects between the operating mechanism sideframes, one of which is indicated at 26A. The manual operating handle 18 interacts with the operating mechanism 21 by means of a pair of plate connectors, one of which is indicated at 22 to move the contacts 16, 17 between the OPEN and CLOSED conditions along with the TRIP or OFF button 19 and the closing button 20, as described earlier.

Figure 2:
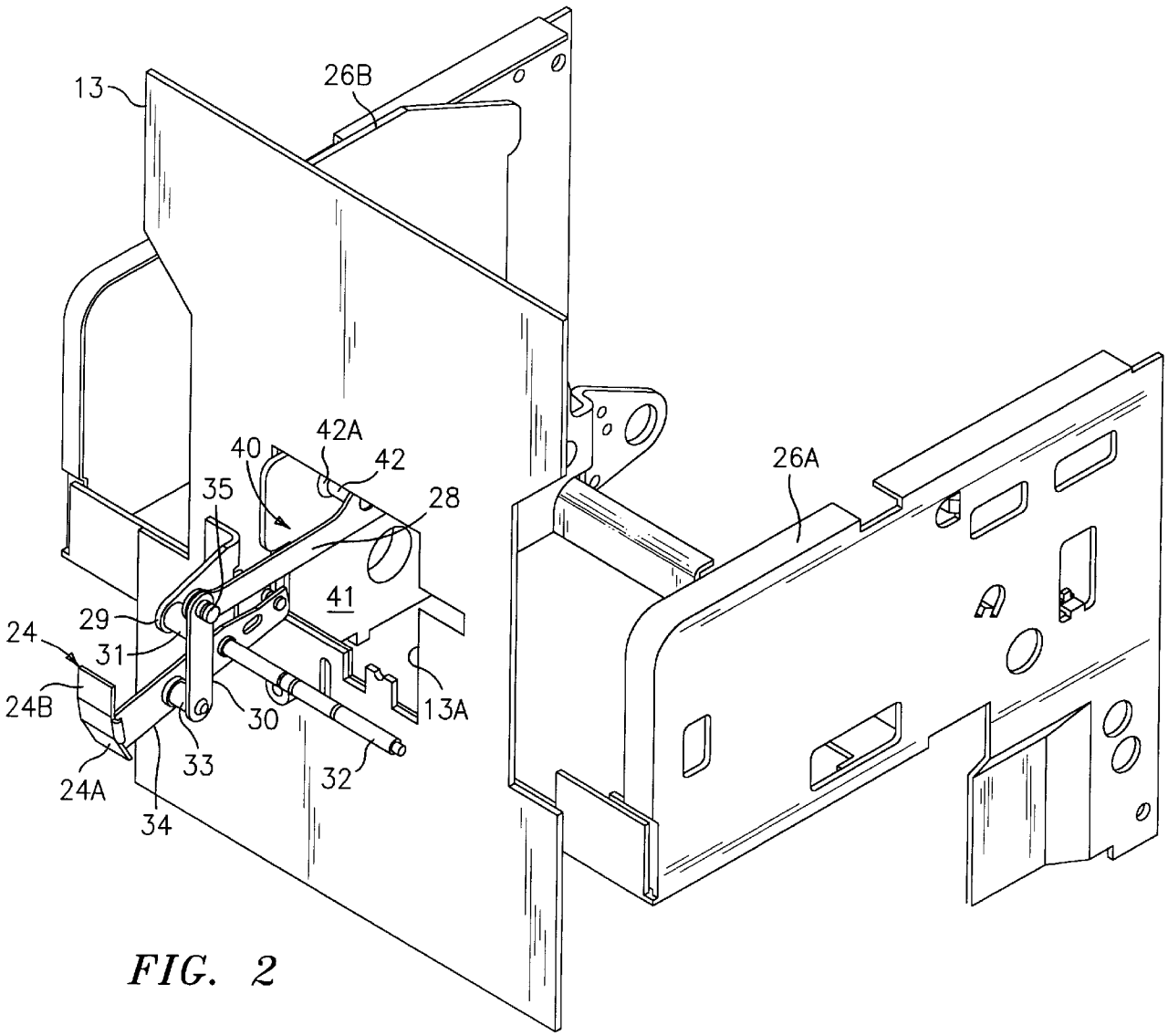
FIG. 2 is a right side perspective view of the contact assembly of FIG. 1 apart from the operating components contained within the circuit breaker of FIG. 1.
Figure 3:
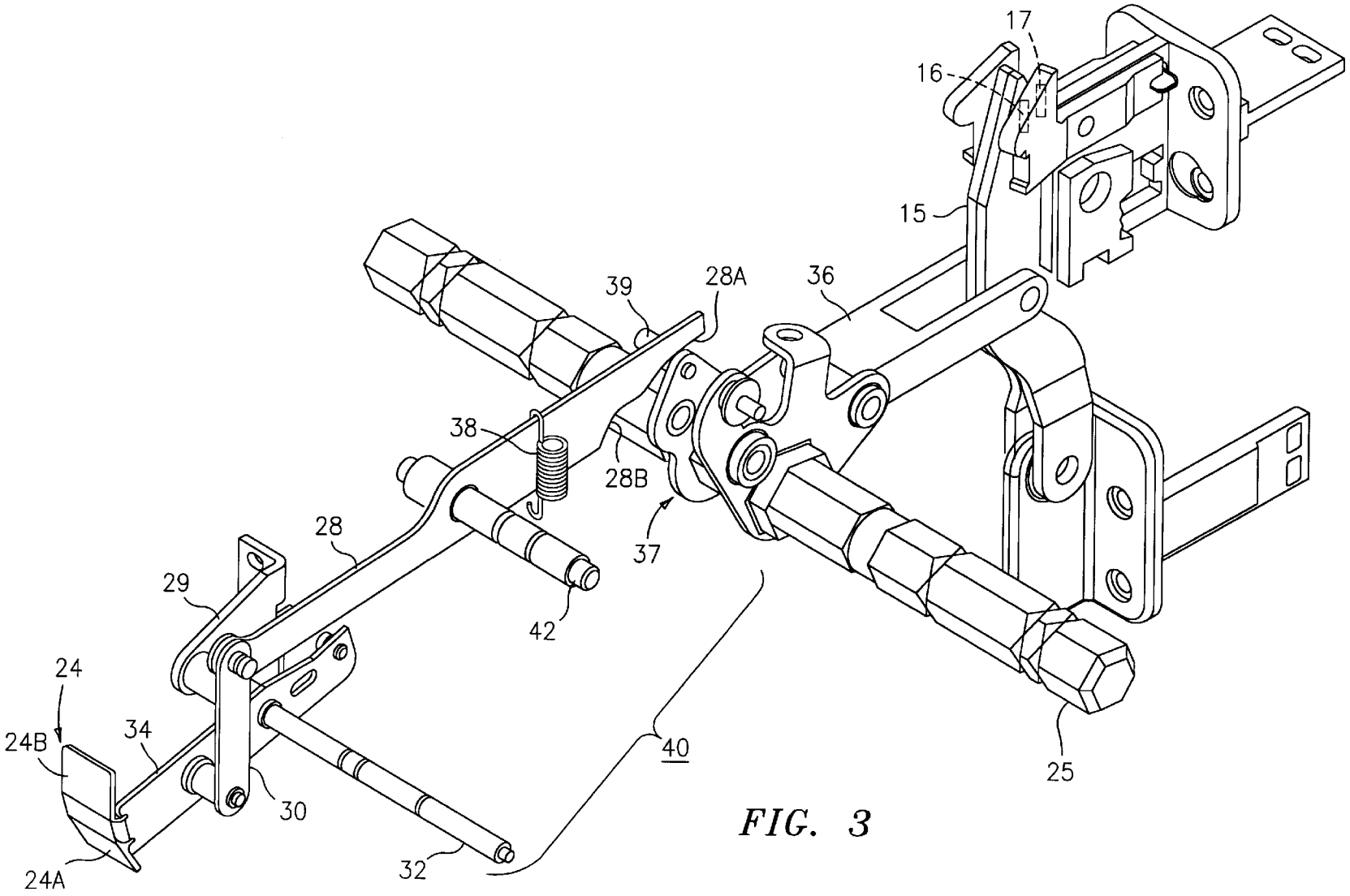
FIG. 3 is a top perspective view of the contact assembly of FIG. 2 assembled to the movable contact carrier pa of the circuit breaker operating mechanism.

The arrangement of the indicator flag 24 on the operating mechanism cover 13 is best seen by now referring jointly to FIG. 2 and FIG. 3, wherein the indicator flag is depicted as having a first part 24A defining the OPEN indicia and a second part 24B defining the CLOSED indicia of the circuit breaker contacts 16,17 of FIG. 1. The indicatin flag 24 has OPEN and CLOSED indicia printed thereon. The indicator flag position in relation to the contacts is accurately controlled by means of an indicator bell crank 40 that is located between the operating mechanism sideframes 26A, 26B and is attached to the circuit breaker cover 13 by means of a support bracket 29. The bell crank includes an indicator drive lever 28 extending through the slot 13A formed in the operating mechanism cover 13 which connects with the indicator plate 34 by means of the drive link 30 and pin fasteners 33, 35. The indicator plate 34 carries the indicator flag 24 and rotates about the indicator pivot shaft 32, which indicator pivot shaft is-rotatably attached to the support bracket 29 by means of a busing 31. The indicator drive lever 28 pivotally attaches with a central support plate 41 by means of the drive lever shaft 42. The drive lever shaft 42 is supported at one end thereof in the slot 42A formed in the support plate. The indicator drive lever 28 pivots on the drive lever shaft 42 to allow vertical motion of the indicator drive 28 lever against the return bias provided by the bias spring 38, which extends between the indicator drive lever 28 and central support plate as shown in FIG. 3. As further shown in FIG. 4 and 5, the indicator drive lever 28 defines a pair of first and second camming surfaces 28A, 28B which ride along the drive pin 39 extending from the drive link 37 in cam follower relation. The positional logic as to the status of the contacts 16, 17 is provided by interconnection between the clevis 36 extending from the movable contact arm 15 drive link 37 attached to the closing shaft 25 by virtue of the positional relationship between the drive pin 39 and the first and second camming surfaces 28A, 28B on the end of the indicating drive lever 28 which extends through the opening 13A in the operating mechanism cover 13, as seen by now referring jointly to FIG. 4 and FIG. 5.

Figure 4:
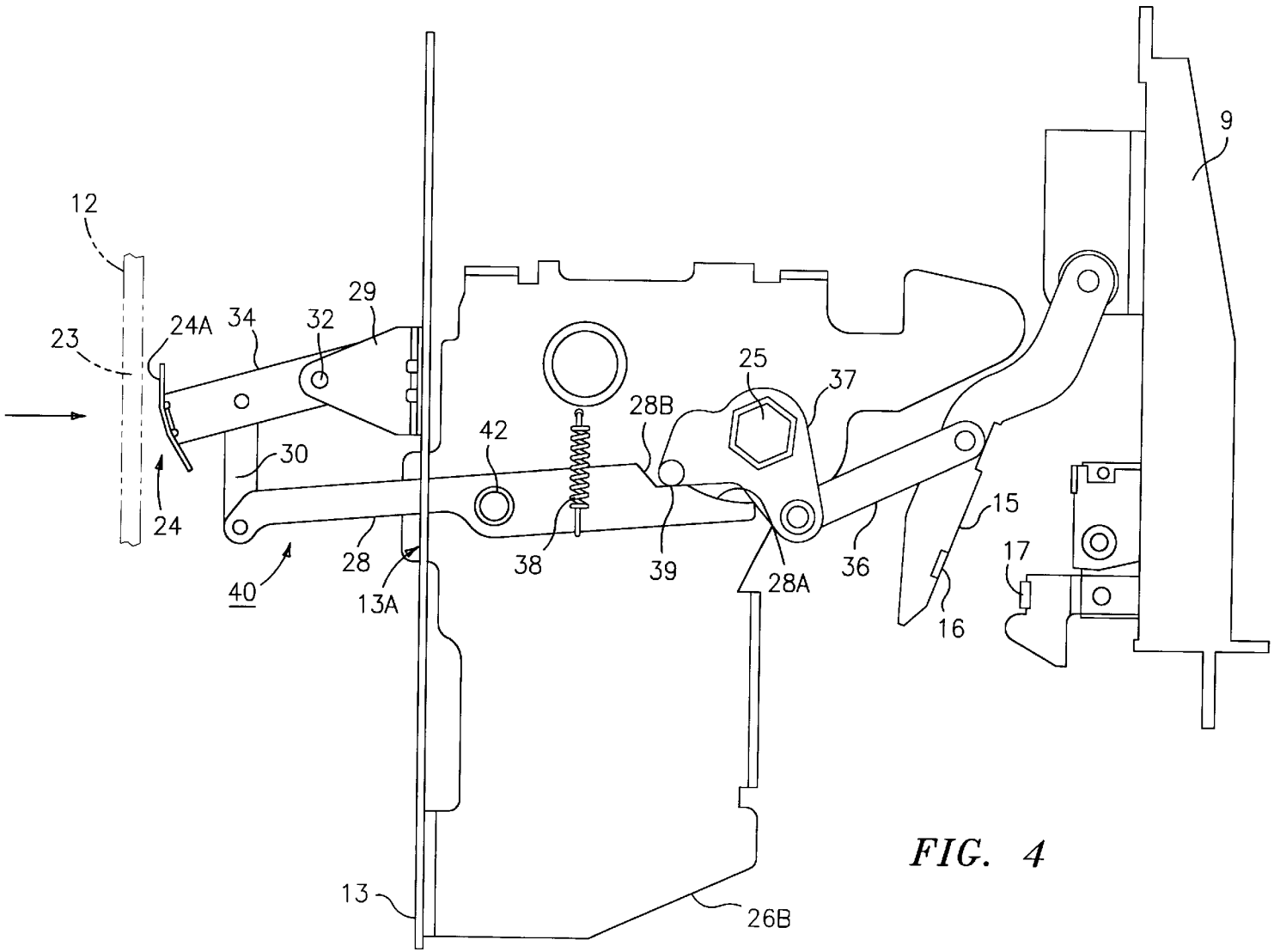
FIG. 4 is left side plan view of the contact assembly of FIG. 1 depicting the target indicator and circuit breaker contacts in the OFF condition.

In FIG. 4, the movable contact 16 on the end of the movable contact arm 15 has separated away from the fixed contact 17 on the bottom support plate 9 by rotation of the closing shaft 25, carrying the drive link 37 and the clevis 36 to the OPEN position. The drive pin 39 on the drive link has moved to the second camming surface 28B on the indicator lever 28 extending the bias spring 38 between the indicator lever and the sideframe 26B. The indicator lever 28 in the indicator bell crank 40, is driven in the counter-clockwise direction about the drive lever shaft 42 whereby the drive link 30 pulls the indicator drive lever 28 and attached indicator flag 24, on the indicating flag lever 34, about the indicator lever pivot 32 on the support bracket 29 to the left of the viewing window 23 formed in the circuit breaker cover 12, both of which are indicated in phantom. In this position of the indicator flag 24, the first part 24A displays the corresponding OPEN indicia under the viewing window 23 allowing visual access thereto as indicated by the arrow.

Figure 5:
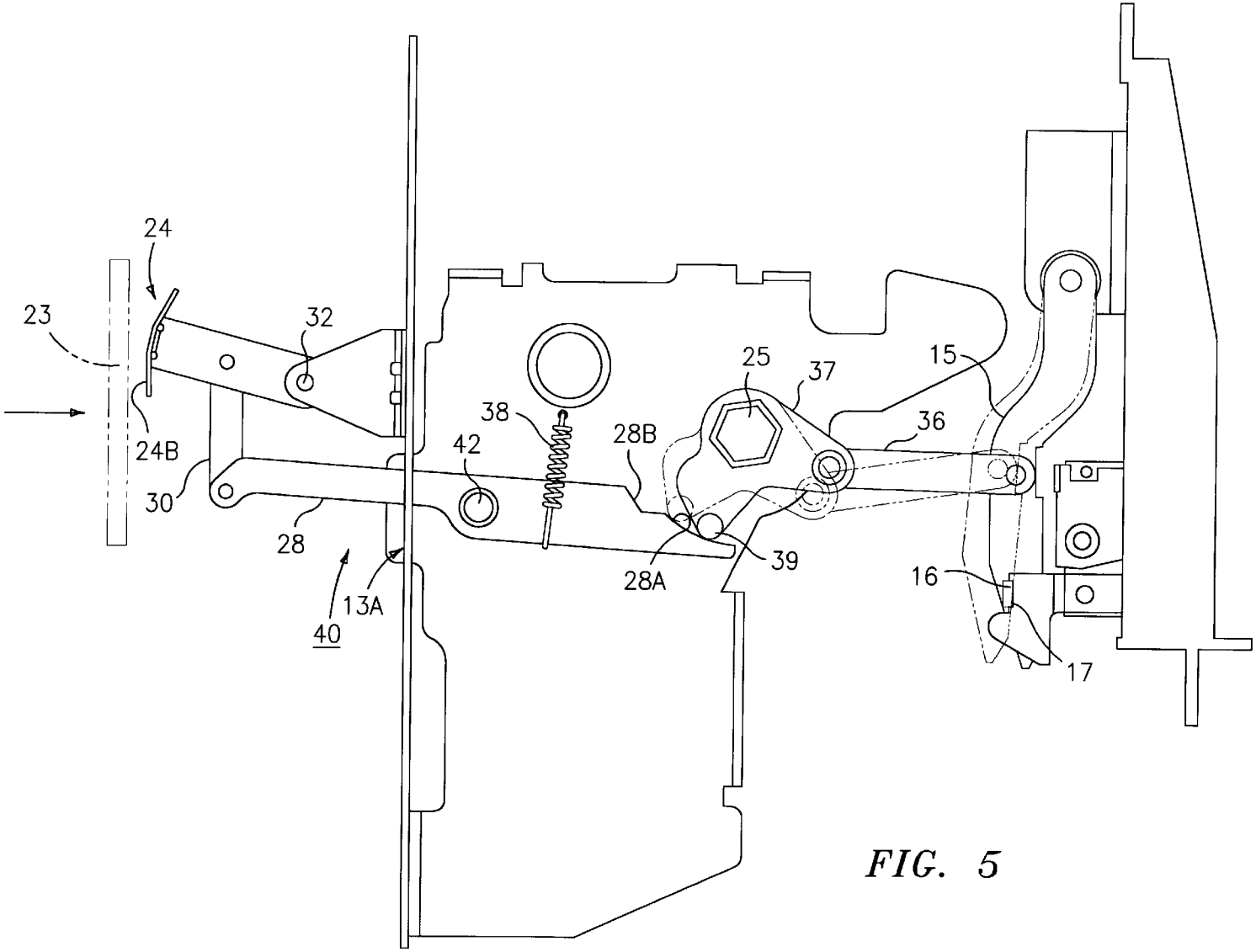
FIG. 5 is a left side plan view of the contact assembly of FIG. 1 depicting the target indicator and circuit breaker contacts in the ON condition.

When the movable contact arm 15 is driven by rotation of the closing shaft 25 in the counter-clockwise direction , the movable contact 16 moves from the OPEN indicated in phantom to the CLOSED condition shown in FIG. 5 against the fixed contact 17, as indicated in solid lines. The rotation of the drive link 37 moves the drive pin 39 along the indicator lever 28 to the first cam surface 28A which causes the indicator lever 28 to become driven in the couliter-clockwise direction about the drive lever shaft 42 whereby the drive link 30 pushes the indicator drive lever 28 and attached indicator flag 24 about the indicator lever pivot 32 on the support bracket 29 to the right of the viewing window 23. In this position of the indicator flag 24, the second part 24B displays the corresponding CLOSED indicia under the viewing window 23 allowing visual access thereto as indicated by the arrow.

A simple bell crank arrangement has herein been described for moving a contact status indicating flag under a viewing window in response to real time movement of the circuit breaker closing shaft and movable contact arm to display the true OPEN and CLOSED status of the circuit breaker contacts.

We claim:

1. A circuit breaker contact condition indicator arrangement comprising:

an indicator flag having OPEN and CLOSED indicia printed thereon;

an indicator level bell crank interfacing between said indicator flag and a circuit breaker closing shaft, said bell crank including an indicating lever pivotally attached within a circuit breaker operating mechanism and coupled to said indicator flag at one end and interacting with a circuit breaker closing shaft at an opposite end thereof; and a drive link connecting between said one end of said indicating lever and said indicator flag;

whereby rotation of said circuit breaker closing shaft in one direction to close circuit breaker contacts moves said indicator flag in a first direction to display said CLOSED indicia and rotation of said circuit breaker closing shaft in an opposite direction to separate circuit breaker contacts moves said indicator flag in a second direction opposite said first direction to display said OPEN indicia.

2. The contact condition indicator of claim 1 wherein said drive link is arranged on said circuit breaker closing shaft, and said drive link further includes a drive pin extending therefrom.

3. The contact condition indicator of claim 2 including a camming surface at another end of said indicator lever, said drive pin being arranged under said camming surface.

4. The contact condition indicator of claim 3 wherein said drive link connects with a clevis attached to a circuit breaker movable contact and whereby said drive link rotates in unison with contact OPEN and CLOSED positions defined by location of a circuit breaker movable contact arm.

5. The contact condition indicator of claim 2 wherein said camming surface defines a first part and a second part, said second part being thicker than said first part and said indicator lever further includes a bias spring connecting between said indicator lever and a circuit breaker operating mechanism whereby said bias spring retains said camming surface against said drive pin.

6. The contact condition indicator of claim 5 wherein said first part of said camming surface maintains said indicator lever and said OPEN indicia against the return force of said bias spring and said second part of said camming surface allows rotation of said indicator lever and said CLOSED indicia under said return force provided by said bias spring.

7. The contact condition indicator of claim 1 wherein said indicator lever is pivotally coupled to a top surface of a circuit breaker operating mechanism enclosure by means of a support bracket.

8. The contact condition indicator of claim 1 wherein said indicator flag defines a surface and said OPEN and CLOSED indicia are arranged on a first part and a second part respectively, said first part and said second part positioned at an angle to said surface to display only one of said OPEN and CLOSED indicia under a circuit breaker viewing window at one time.

9. A circuit breaker comprising:

a support frame;

a circuit breaker cover supported by said support frame;

an operating mechanism supported by said support frame;

a moveable contact arm interacting with said operating mechanism opening and closing a pair of contacts;

an ON and an OFF button on said cover for interacting with said operating mechanism to close and open said contacts;

a viewing window on said cover providing indication as to the ON and OFF conditions of said contacts;

an indicator flag and an indicator lever bell crank including an indicating lever pivotally attached within a circuit breaker operating mechanism and coupled to said indicator flag at one end and interacting with a circuit breaker closing shaft at an opposite end thereof;

a drive link connecting between said one end of said indicating lever and said indicator flag;

whereby rotation of said circuit breaker closing shaft in one direction to close circuit breaker contacts moves said indicator flag in a first direction to display a CLOSED indicia and rotation of said circuit breaker closing shaft in an opposite direction to separate circuit breaker contacts moves said indicator flag in a second direction opposite said first direction to display an OPEN indicia.

10. The circuit breaker of claim 9 wherein said drive link is arranged on said circuit breaker closing shaft, and said drive link further includes a drive pin extending therefrom.

11. The circuit breaker of claim 10 including a camming surface at another end of said indicator lever, said drive pin being arranged under said camming surface.

12. The circuit breaker of claim 11 wherein said camming surface defines a first part and a second part, said second part being thicker than said first part and said indicator lever further includes a bias spring connecting between said indicator lever and a circuit breaker operating mechanism whereby said bias spring retains said camming surface against said drive pin.

13. The contact condition indicator of claim 12 wherein said first part of said camming surface maintains said indicator lever and said OPEN indicia against the return force of said bias spring and said second part of said camming surface allows rotation of said indicator lever and said CLOSED indicia under said return force provided by said bias spring.

14. The circuit breaker of claim 12 wherein said drive link connects with a clevis attached to said circuit breaker movable contact arm whereby said drive link rotates in unison with contact OPEN and CLOSED positions defined by location of a circuit breaker movable contact arm.

15. The contact condition indicator of claim 14 wherein said flag indicator plate defines a horizontal surface and said OPEN and CLOSED indicia are arranged at an angle to said horizontal surface to display only one of said OPEN and CLOSED indicia under said circuit breaker viewing window at one time.

16. The contact condition indicator of claim 9 wherein said indicator lever is pivotally coupled to a top surface of a circuit breaker operating mechanism enclosure by means of a support bracket.

* * * * *